US005607211A

United States Patent [19]

Henninger et al.

[11] Patent Number: 5,607,211

[45] Date of Patent: Mar. 4, 1997

[54] FOUNTAIN BEVERAGE CENTER

[75] Inventors: David B. Henninger, Marrietta, Ga.; Jeffrey A. Rutchik, North Easton, Mass.; Robert A. Crosby, Jr., Scituate, Mass.; Michael E. Goodell, North Easton, Mass.; Charles W. Pasewark, Framingham, Mass.

[73] Assignee: The Coca-Cola Company, Atlanta, Ga.

[21] Appl. No.: 410,278

[22] Filed: Mar. 24, 1995

[51] Int. Cl.[6] ..... A47B 97/00

[52] U.S. Cl. ..... 312/204; D7/301; D7/306; 222/78; 222/129.1; 221/24; 312/107; 312/140.4; 312/351.1

[58] Field of Search ..... D7/301, 306, 307; D20/3, 4, 5; 312/204, 279, 107, 108, 140.1, 140.3, 140.4, 229, 351.1, 234; 222/78, 129.1, 146.6; 221/24, 92

[56] References Cited

U.S. PATENT DOCUMENTS

| | | | |
|---|---|---|---|
| D. 82,798 | 12/1930 | Crosby . | |
| D. 87,246 | 6/1932 | Wagner . | |
| D. 145,785 | 10/1946 | Bjorksten | 312/140.1 X |
| D. 287,688 | 1/1987 | Mortimer | D7/307 |
| D. 294,105 | 2/1988 | Mathews | D7/307 |
| D. 315,175 | 3/1991 | Phillips et al. | D20/5 |
| D. 347,960 | 6/1994 | Strohmeyer et al. | D7/307 |
| D. 359,649 | 6/1995 | Salkeld et al. | D7/307 |
| 3,732,633 | 5/1973 | Margous et al. | 312/234 X |
| 4,489,996 | 12/1984 | Norton et al. | 312/279 X |
| 5,259,669 | 11/1993 | Leach et al. | 312/108 X |
| 5,413,245 | 5/1995 | Wright | 221/24 |

FOREIGN PATENT DOCUMENTS

| | | | |
|---|---|---|---|
| 3273481 | 12/1991 | Japan . | |
| 3-273481 | 12/1991 | Japan | 221/24 |
| WO91/17949 | 11/1991 | WIPO | 222/129.1 |

*Primary Examiner*—Peter M. Cuomo
*Assistant Examiner*—Stephen Vu
*Attorney, Agent, or Firm*—Birch, Stewart, Kolasch & Birch, LLP

[57] ABSTRACT

A fountain beverage center or the like has a main component being a beverage dispenser cabinet having an external shape and appearance which simulates a serving cup for the beverages to be dispensed therefrom. The cabinet includes a base unit with a bowed panel having a frusto-conical shaped outline for simulating the shape of a portion of the serving cup. The top unit includes a pair of side panels having frusto-conical shaped outlines and bowed exterior surfaces which simulate the appearance of other portions of the serving cup. A beverage dispenser assembly is provided between the side panels of the top unit on a countertop of the base unit. At least one refreshment dispenser assembly can be disposed adjacent to the cabinet for dispensing secondary refreshment products.

16 Claims, 5 Drawing Sheets

FOUNTAIN BEVERAGE CENTER

BACKGROUND OF THE INVENTION

The present invention relates to a fountain beverage, refreshment, center for use for self-service applications in grocery or convenience stores or the like. More specifically, the present invention relates to a fountain beverage center or the like wherein a main component of the center is a beverage dispenser cabinet having an external shape and appearance which simulates a serving cup for the beverages to be dispensed therefor.

It is generally known in the dispensing art to provide dispenser housings which are generally shaped to simulate the appearance of a serving cup for a cold beverage such as a soft drink.

It is also known to provide a can vending machine which provides simulated drinking straws as ornamentations for the housings of vending machines in order attract the attention of a customer and draw them to the machine in order to increase sales volume. It is also known in the art to provide vending machines having enlarged primary product selection buttons, as compared to the size of the secondary product selection buttons, on a can vending machine in order to induce higher volumes of sales of primary products than secondary products.

All of the above features are advantageous in increasing the sales of products from vending machines, beverage dispensers, or the like. However, there is still a need in the art for improved self-service fountain beverage centers of grocery, convenience stores or the like, and for highly visible and attractive displays which will increase the sale of impulse purchase items in the store, such as soft drinks and related refreshments.

There is also a need in the art for an improved fountain beverage center for use in convenience stores with a modular assembly which can be customized for the convenience store location in which it is installed.

SUMMARY OF THE INVENTION

Accordingly, it is the primary object of the present invention to provide an improved fountain beverage center which has an appearance which elevates the awareness of the fountain area within the store.

It is another object of the present invention to provide a self-service fountain beverage center having an appearance which increases interest in the fountain purchase of products.

It is still another object of the present invention to provide a fountain beverage center with an appearance, and arrangement of components, which enhances customer satisfaction with the purchase experience.

It is yet another object of the present invention to provide a fountain beverage center for dispensing both primary beverage products and secondary refreshment products wherein the appearance and arrangement of the components of the center are such that there is an inducement for the customer to purchase primary products in larger volumes than the secondary products.

The objects of the present invention are fulfilled by providing a cabinet for a beverage dispenser which simulates the appearance of a serving cup for the beverage comprising:

a base unit including upstanding front, side, and rear walls connected to a horizontal countertop, and a bowed panel on the front wall having a frusto-conical shaped outline for simulating the shape of a portion of the serving cup; and a top unit supportable on the countertop of the base unit, said top unit including a pair of side panels having frusto conical-shaped outlines and bowed exterior surfaces which simulate the appearance of other portions of the serving cup, said side panels being spaced laterally on the countertop in the provision of a chamber for accommodating a beverage dispenser assembly therein;

whereby the base and the top units together simulate the overall appearance of the serving cup for a beverage to be dispensed.

A complete beverage center also includes one or more adjacent dispenser assemblies for secondary products such as sports drinks, teas and frozen carbonated beverages. The cup-shaped dispenser unit is preferably used to dispense primary products, namely, carbonated soft drinks.

The simulated large graphic cup of the present invention is sized to extend high above the visual clutter of the merchandise shelves in a convenience store. Preferably the cup is about 9 feet tall. The size and color of the cup elevate awareness of the fountain area with dynamic visual impact.

Display panels for the fountain beverage center of the present invention include thirst-inducing graphics associated with a breadth of product categories offered for the customer's choice. The size/price/value options are clearly communicated to the customers.

The overall layout of the modular arrangement of the fountain beverage center also enhances customer satisfaction with the purchase experience. The in-line arrangement of cups/lids/straws, and easy access to trash receptacles, make use of the beverage center quick, clean and easy. The design layout also enables heavy traffic to move quickly through the beverage center during peak periods. The beverage center also complies with ADA regulations.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objects of the present invention and the attendant advantages thereof will become more readily apparent by reference to the drawings, like reference numerals refer to like parts, and wherein.

DETAILED DESCRIPTION OF PREFERRED EMBODIMENTS

Figure 1:
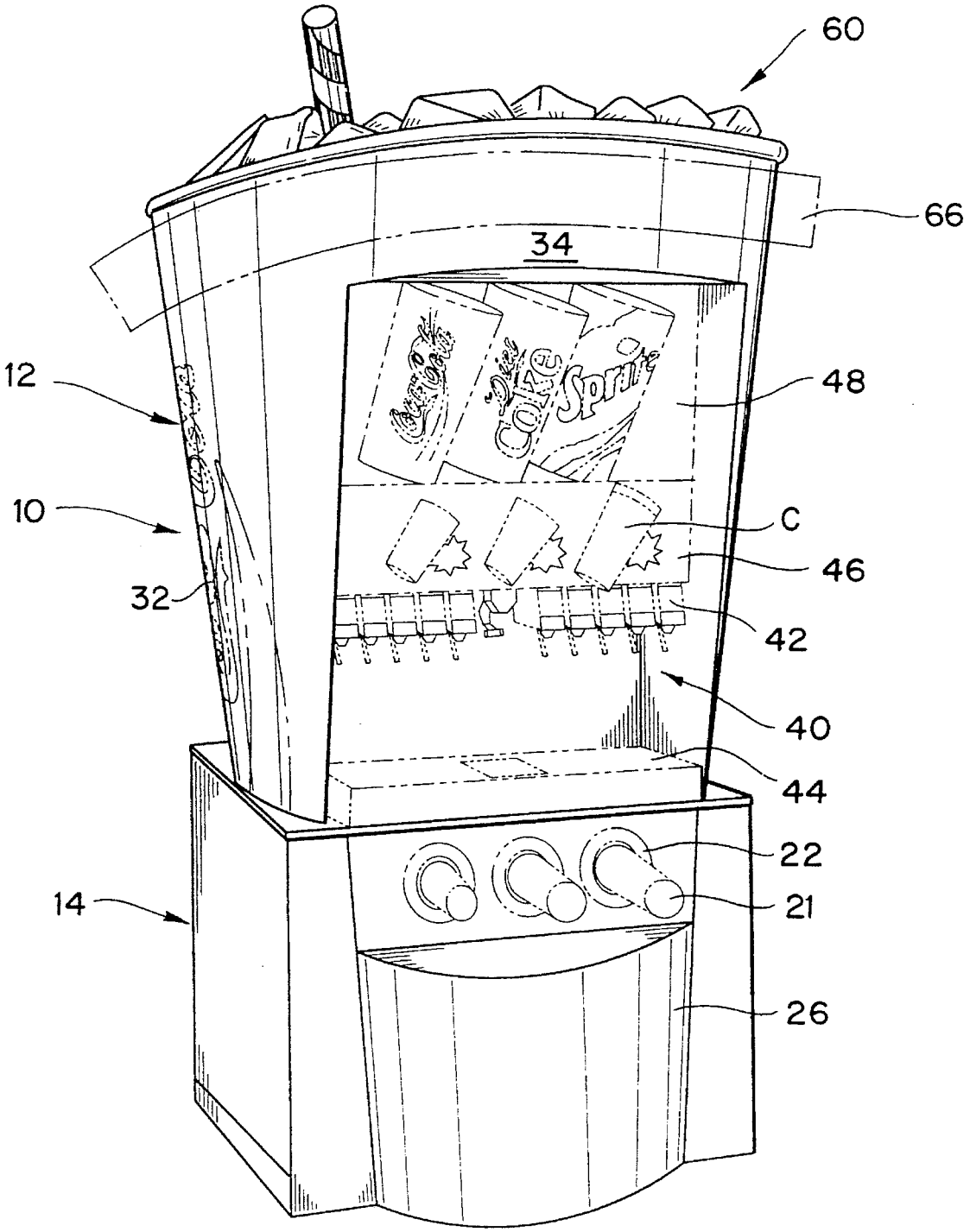
FIG. 1 is a perspective view of the dispenser cabinet of the present invention which simulates the appearance of a beverage serving cup.

Referring in detail to FIG. 1, a cup-shaped dispenser cabinet is generally indicated 10. The cabinet includes a top unit 12 and a bottom unit 14 for supporting the top unit 12 thereon.

Figure 2:
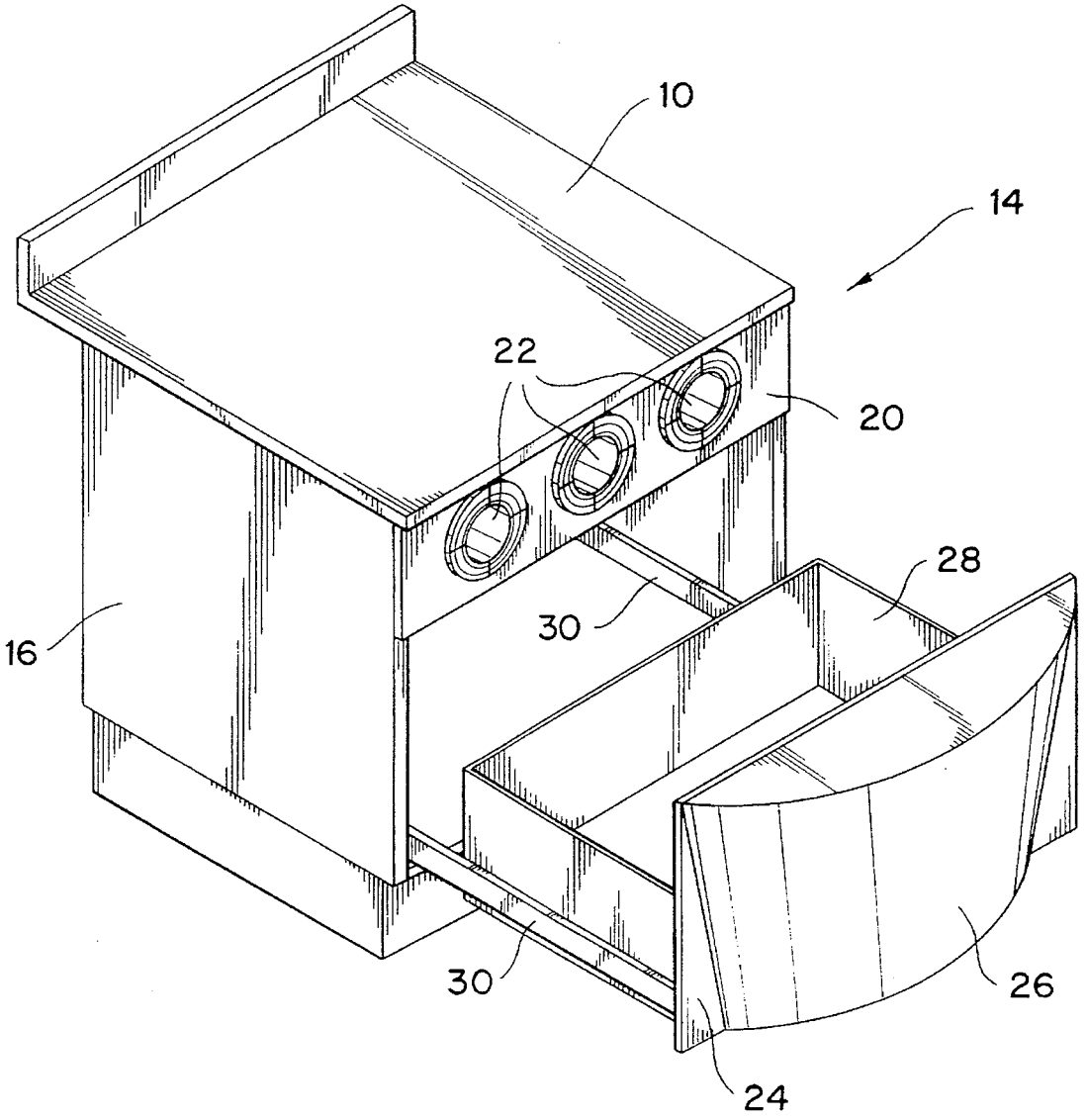
FIG. 2 is a perspective view of a base unit portion of the dispenser cabinet of FIG. 1 illustrating an associated trash drawer in an open position.
Figure 3:
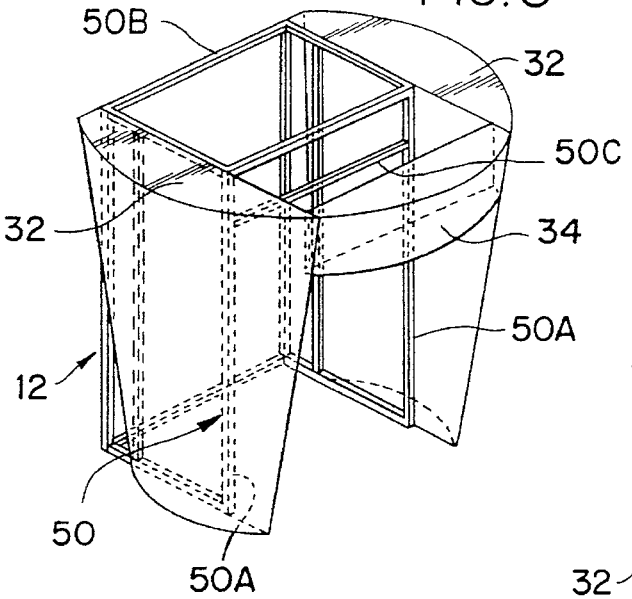
FIG. 3 is a perspective view of the top unit of the cabinet of FIG. 1 which is supportable on the base unit of FIG. 2.
Figure 4:
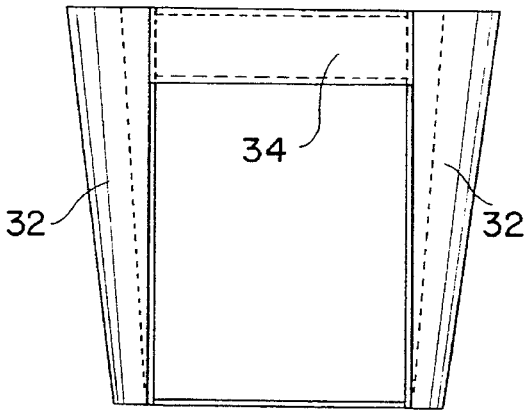
FIG. 4 is a front elevational view of the top unit of FIG. 3.
Figure 5:
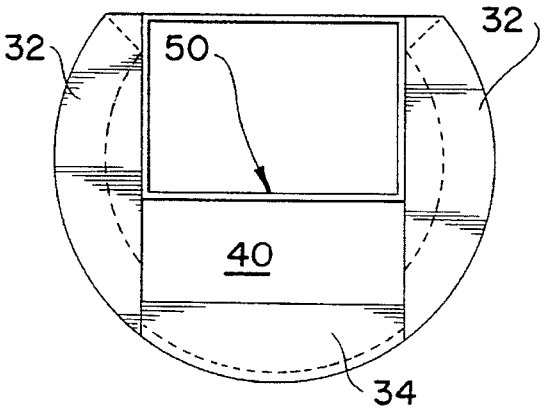
FIG. 5 is a top plan view of the top unit of FIG. 3.

Details of the bottom unit 14 are illustrated in FIG. 2 and include a cabinet 16 having a horizontal countertop 18 for supporting the top unit 12. A front panel 24 forms the front face of a drawer including a bin 28 for receiving trash, supplies or the like. The drawer is mounted on slides 30 of conventional types, such as used for drawers of file cabinets. A bowed panel 26 having a frusto-conical outline is secured to the front of panel 24 to simulate the appearance of a bottom portion of the overall cup-like shape depicted by the cabinet 10.

A plurality of cup-receiving sockets 22 are provided in a front panel 20 just above bowed panel 26 for accommodating nested groups of cups of different sizes such as small, medium and large. The cups 21 are illustrated in FIG. 1 within the sockets 22.

Referring again to FIG. 1, the top unit 12 includes a pair of spaced side panels 32 which are bowed or curved in the shape of portions of a cup and have frusto-conical outlines. The space between the side panels 32 defines a chamber for accommodating a soft drink (post-mix) beverage dispenser 40 having a plurality of selection buttons 42 for different flavor beverages, a drip tray 44 on which a cup to be filled is placed, and sign panels above the selection buttons 42 including appropriate graphics.

One sign panel includes a plurality of three-dimensional cups 46 protruding therefrom the sign panel and corresponding in actual size to the small, medium and large cups 21 provided in cup dispenser sockets 22. An upper sign panel 48 may include graphics of the products selectable by buttons 42. These graphics may be customized for various customers but in the embodiment illustrated, these graphics illustrate three primary soft drink products available for purchase from the dispenser 40. An additional sign panel 66 may be provided along the top edge of the cabinet and extends across adjacent refreshment assemblies (FIG. 8) to provide increased awareness of the fountain beverage center to customers within the grocery or convenience store. The graphics on sign panel 66 may also be customized for various customers.

On the top of the cabinet, 10 and top unit 12 is a top panel 60 including a plurality of translucent chunks of material 62 thereon which simulate the appearance of ice cubes floating within a beverage in the simulated cup. Top panel 60 preferably has a peripheral bead which simulates the bead on the top of a typical beverage-serving cup.

Also provided is a tube 64 extending into and from the top panel 60 in order to simulate the appearance of a drinking straw extending from the simulated cup of beverage. All of these features together simulate the appearance of a drinking or serving cup of a cool beverage having ice floating therein and a straw protruding therefrom in order to attract the attention of customers and stimulate the sale of beverages and related refreshments from the fountain beverage center of the present invention.

Details of the cabinet structure of top unit 12 are illustrated in FIGS. 3 to 7. Side panels 32 are mounted within a frame assembly 50. Frame assembly 50 includes spaced, side rectangular framed portions 50A joined by a top rectangular frame 50B and strengthened by a cross brace 50C. Side panels 32 include interior protrusions 32A (FIG. 7) which fit into side rectangular frame portions 50A. Suitable fasteners are provided in order to removably secure panels 32 within side frame members 50A. A curved front panel 34 is provided for bridging side panels 32 and completing the curvature of a front face of the simulated serving cup.

Figure 9:
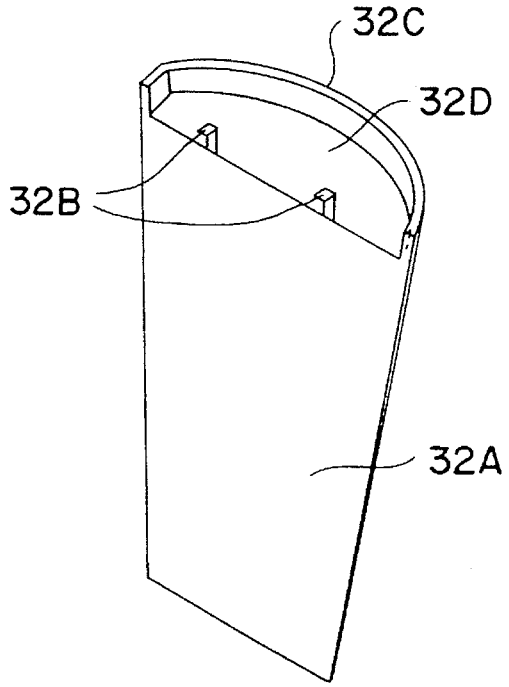
FIG. 9 is an alternative embodiment of a bowed, cup-shaped side panel.

An alternative embodiment of side panels 32 is illustrated in FIG 9, as panel 32A. Panel 32A includes hooks 32B which are engageable with the top of a support frame, similar to frame 50. Panel 32A also has a peripheral bead 32C simultating the appearance of a cup rim. Recessed below bead 32C is a support surface 32D for supporting simulated ice chunks 62.

Figure 10:
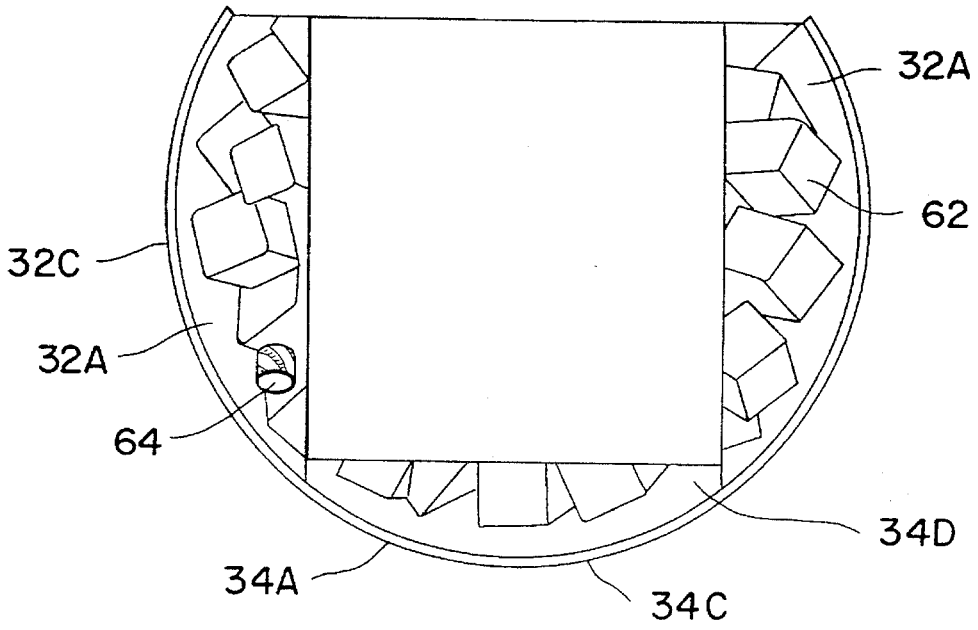
FIG. 10 is a top plan view depicting how the simulated ice may be supported in the top of the cabinet of the present invention.

FIG. 10 shows how two panels 32A are combinable with a front panel 34A having a similar peripheral bead 34C and recessed support surface 34D to form a continuous cup rim. The ice chunks are supported about the rim or support surfaces 32D, 34D.

Suitable lighting may be provided under ice chunks 62, if desired, to make them more visible.

Figure 6:
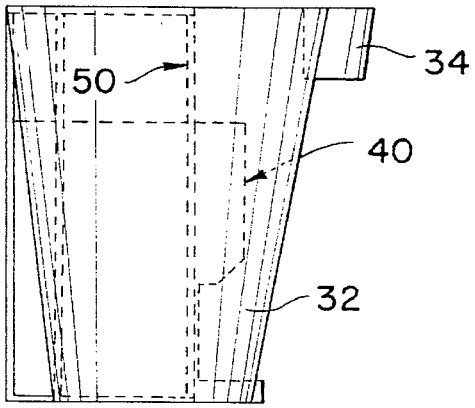
FIG. 6 is a side elevational view of the top unit of FIG. 3 illustrating how an associated beverage dispenser is accommodated within a chamber of the top unit.
Figure 7:
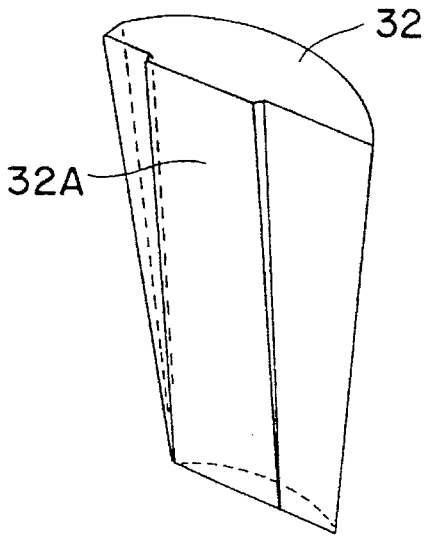
FIG. 7 is a perspective view of a first embodiment one of the two bowed, cup-shaped, side panels for the top unit of FIG. 3.

The side elevational view of FIG. 6 illustrates how the beverage dispenser 40 fits within the chamber formed by frame assembly 50 and associated bowed sign panels 32. Any type of beverage dispenser which fits into this space may be utilized and the one illustrated in FIG. 6 is merely exemplary of a suitable beverage dispenser.

Figure 8:
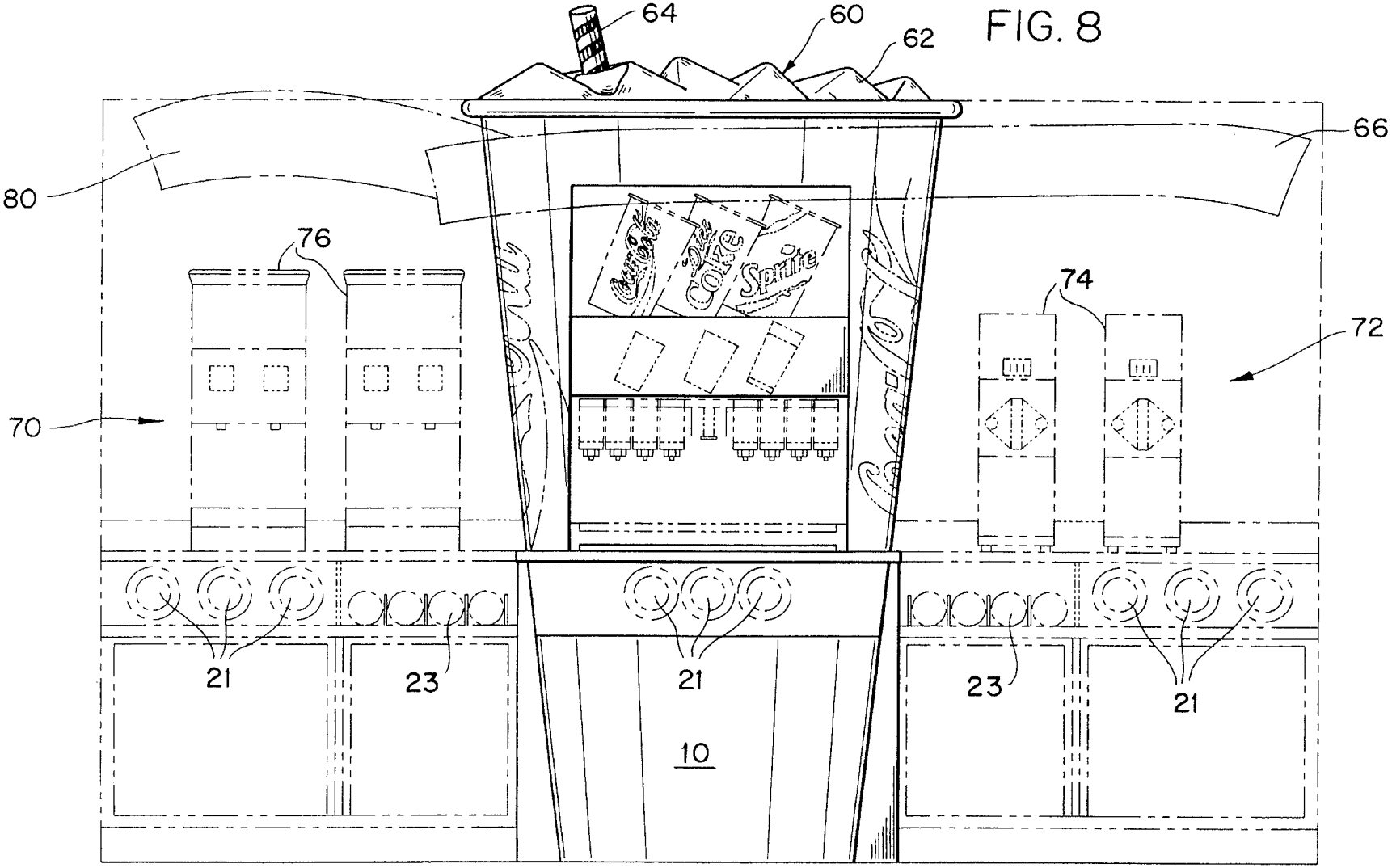
FIG. 8 is a front elevational view of the dispenser cabinet of FIG. 1 in combination with a pair of additional refreshment dispenser assemblies on opposite sides thereof in order to form a preferred embodiment of a complete fountain beverage center of the present invention.

FIG. 8 a preferred embodiment of a complete beverage center in accordance with the present invention wherein additional refreshment assemblies 70 and 72 are provided on opposite sides of the cabinet 10 of the main beverage dispenser unit of the present invention. The refreshment assembly 70, for example, may include a plurality of dispensers 76 for dispensing products such as tea, or sport drinks or juices. The refreshment assembly 72 may include a plurality of dispenser 74 for frozen carbonated beverages. Accordingly, the beverage center offers a variety of choices to the customers and the overall appearance attracts the customers to the beverage center.

FIG. 8 also illustrates how a plurality of nested cups 21 and lids 23 are disposed in a horizontal in-line arrangement to provide a neat appearance and efficient arrangement of the same to accommodate heavy traffic during peak serving periods. An additional sign panel 80 may be provided for additional graphics to supplement those on sign panel 66 and display panel 48.

The central cabinet 10 and its simulated cup shape is a dominant portion of the beverage center in the configuration of FIG. 8. Accordingly, it can be seen that a customer approaching the center would be primarily attracted to the central cup-shaped cabinet for the purchase of soft drinks therefrom. These soft drinks are defined for the purposes of the description herein as "primary products" and the refreshments dispensed from dispenser 74 and 76 can be defined "secondary products". It is likely that a customer would be induced to purchase the "primary products" in greater volumes than the "secondary products" in view of the dominant nature of the central beverage cabinet 10. This is generally desirable for the supplier of the products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cabinet for a beverage dispenser which simulates the appearance of a serving cup for the beverage comprising:

a base unit including upstanding front, side, and rear walls connected to a horizontal countertop, and a bowed panel on the front wall having a frusto-conical shaped outline for simulating the shape of a portion of the serving cup, the bowed panel being spaced from top and side edges of the front wall of the base unit to provide generally planar surfaces adjacent the bowed panel; and a top unit supportable on the countertop of the base unit, said top unit including a pair of side panels having frusto-conical shaped outlines and bowed exterior surfaces which simulate the appearance of other portions of the serving cup, said side panels being spaced laterally on the countertop in the provision of a chamber for accommodating a beverage dispenser assembly therein;

whereby the base and the top units together simulate the overall appearance of the serving cup for a beverage to be dispensed.

2. The cabinet of claim 1 further including cup holder means disposed at the bowed panel of the base unit.

3. The cabinet of claim 2 wherein said cup holder means includes a plurality of sockets at said bowed panel for receiving nested serving cups therein.

4. The cabinet of claim 1 wherein the top unit further includes a top panel bridging said pair of said panels above said chamber and a plurality of translucent chunks of material disposed on the top panel which simulate the appearance of ice floating in a beverage within the serving cup.

5. The cabinet of claim 4 further including a tube extending above said chunks of material, said tube simulating the appearance of a drinking straw for the beverage in the serving cup.

6. A self-serve refreshment center comprising:

a) a cabinet for a beverage dispenser which simulates the appearance of a serving cup for primary product beverages including a plurality of exterior panels having frusto-conical outlines which individually simulate the appearance of portions of the serving cup and collectively the overall appearance of the serving cup, some of said panels being spaced to provide a chamber therebetween for accommodating a beverage dispenser assembly therein and one of the panels on a front wall of the cabinet being bowed, the bowed panel spaced from top and side edges of the front wall to thereby provide generally planar surfaces adjacent the bowed panel;

b) a beverage dispenser assembly within said chamber for dispensing primary beverage products; and c) at least one refreshment dispenser assembly disposed adjacent to the cabinet for dispensing secondary refreshment products;

whereby the cabinet, which simulates the appearance of a beverage cup, attracts customers to the beverage center and induces greater sales of the primary products than the secondary products.

7. The refreshment center of claim 6, the cabinet including:

a base unit including upstanding front, side, and rear walls connected to a horizontal countertop, the bowed panel on the front wall having a frusto-conical shaped outline for simulating the shape of a portion of the serving cup; and a top unit supportable on the countertop of the base unit, said top unit exterior panels including a pair of side panels having frusto conical-shaped outlines and bowed exterior surfaces which simulate the appearance of other portions of the serving cup, said side panels being space laterally on the countertop in the provision of the chamber for accommodating the beverage dispenser assembly therein.

8. The refreshment center of claim 7 further including cup holder means disposed at the bowed panel of the base unit.

9. The refreshment center of claim 8 wherein said cup holder means includes a plurality of sockets at said bowed panel for receiving nested serving cups therein.

10. The refreshment center of claim 9 wherein said at least one refreshment dispenser assembly also includes a plurality of sockets for receiving nested serving cups, all sockets in the cabinet and refreshment dispenser assembly being disposed in a horizontal in-line row.

11. The refreshment center of claim 7 wherein the top unit further includes a top panel bridging said pair of side panels above said chamber and a plurality of translucent chunks of material disposed on the top panel which simulates the appearance of ice floating in a beverage within the serving cup.

12. The refreshment center of claim 11 further including a tube extending above said chunks of material, said tube simulating the appearance of a drinking straw for the beverage in the serving cup.

13. The refreshment center of claim 6 said beverage dispenser assembly including a front panel with a plurality of three-dimensional portions of serving cups protruding therefrom, each of said portions illustrating a different size serving cup corresponding to beverage sizes dispensable by the beverage dispenser.

14. The refreshment center of claim 7 further including a beverage dispenser within the cabinet, said dispenser including a front panel with a plurality of three-dimensional portions of serving cups protruding therefrom, each of said portions illustrating a different size serving cup corresponding to beverage sizes dispensable by the beverage dispenser.

15. The refreshment center of claim 6 including at least two refreshment dispenser assemblies for secondary products, one being disposed on each side of said cabinet.

16. The refreshment center of claim 15 further including at least one display panel disposed along the top of the center and bridging the cabinet and adjacent refreshment dispenser assemblies.

* * * * *